United States Patent [19]

Glassman

[11] Patent Number: 4,903,871

[45] Date of Patent: Feb. 27, 1990

[54] POCKET CREASING MACHINE

[75] Inventor: Lee Y. Glassman, Scranton, Pa.

[73] Assignee: Automated Components International, Inc., Dunmore, Pa.

[21] Appl. No.: 201,731

[22] Filed: Jun. 2, 1988

[51] Int. Cl.[4] ..... A41H 33/00

[52] U.S. Cl. ..... 223/38

[58] Field of Search ..... 223/37, 38, 52

[56] References Cited

U.S. PATENT DOCUMENTS

| | | | |
|---|---|---|---|
| 2,238,048 | 4/1941 | Gilbert | 223/38 |
| 2,858,967 | 11/1958 | Gilbert | 223/38 |
| 2,884,168 | 4/1959 | Portera | 223/38 |
| 4,124,424 | 11/1978 | Preston | 223/38 X |
| 4,319,702 | 3/1982 | Preston | 223/38 |
| 4,445,631 | 5/1984 | del Castillo-Olivares | 223/38 X |

FOREIGN PATENT DOCUMENTS

| | | | |
|---|---|---|---|
| 1138643 | 6/1957 | France | 223/38 |

*Primary Examiner*—Werner H. Schroeder
*Assistant Examiner*—David K. Suto
*Attorney, Agent, or Firm*—Kane, Dalsimer, Sullivan, Kurucz, Levy, Eisele and Richard

[57] ABSTRACT

An apparatus for folding and creasing pocket material is provided. A table has a heating plate mounted thereon. A top die has upper and lower die plates for folding material therebetween, the lower die plate being wider than the upper die plate. The top die is lowered between the side dies which move inwardly to fold and crease the pocket material.

8 Claims, 2 Drawing Sheets

FIG. 1
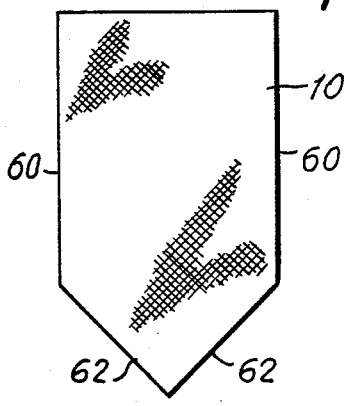
FIG. 2
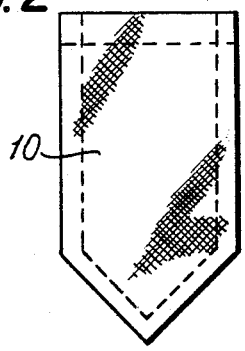
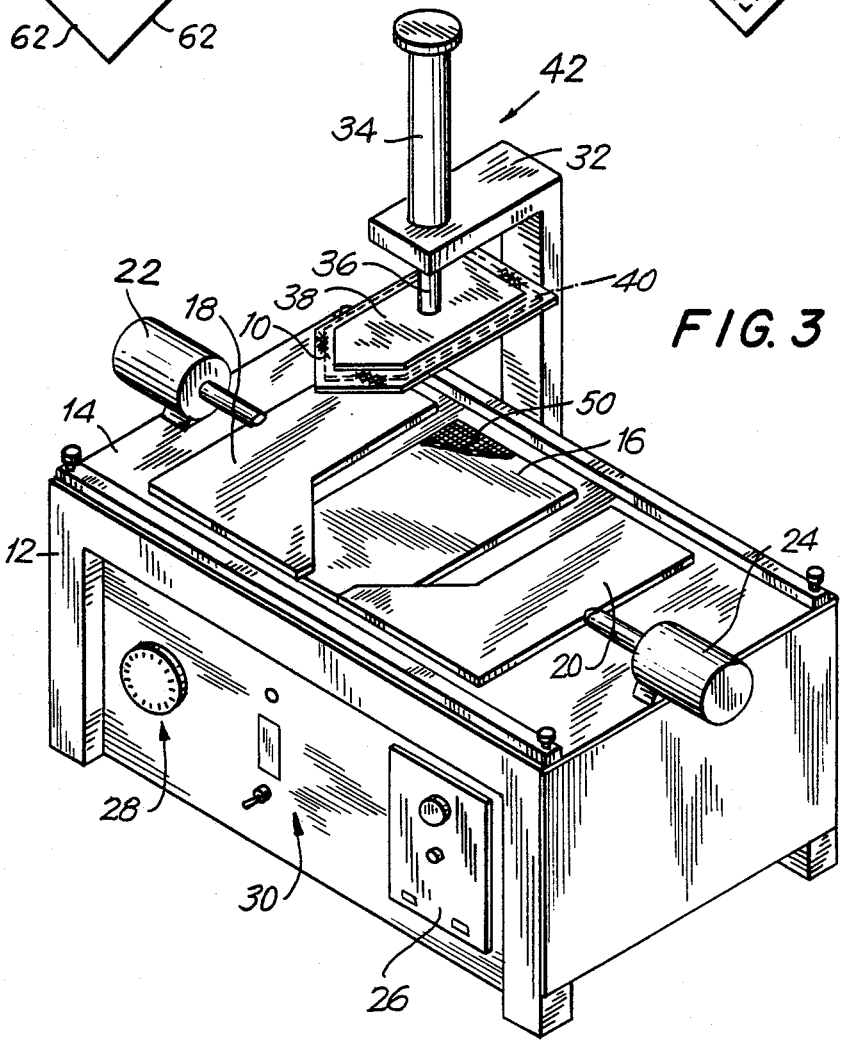
FIG. 3

POCKET CREASING MACHINE

FIELD OF THE INVENTION

The present invention pertains to garment manufacturing, and more particularly to an apparatus for creasing pockets in preparation for sewing.

BACKGROUND

In the past processes for creasing pockets have encountered a variety of problems. Many existing creasing processes involve manual steps which are both time consuming and dangerous. The hazards involved in these systems have led to the development of automated folding systems. However, the automated systems have likewise encountered problems. Loading commonly takes place in areas where plates are heated with resultant danger of scorching hands as well as rushing of the loading process. In addition, systems using a top die and lowering it onto a heating plate have used a single top die plate. This has resulted in problems of misalignment of feed, double creasing of fold, and numerous other problems.

SUMMARY OF THE INVENTION

The primary object of the present invention is to provide a pocket creasing machine having maximal safety in that the operator's hand are never in folding or heating areas nor in areas of moving dies. The loading takes place above the heated plate at ambient temperature—a major advance in creasing systems. A novel die system is provided wherein the top die contains double plates, the lower plate being the wider of the two to prevent double creasing of pocket materials.

Another object is to provide a pocket creasing system wherein pockets are loaded faster, are simpler to align, and are folded with precision. The precision character of the present system is particularly beneficial for pockets with stripes and patterns.

A further object of the present invention is to provide a steam feed, the steam facilitating and assisting in the folding process and wherein loading of material at a location raised from the heat plate assures safe loading despite steam and heating.

A still further object of the present invention is to achieve higher production levels in pocket preparation for garment manufacture.

The folding and creasing machine of the present invention includes a table; a first and second side die supported above the table by side die moving means and located spaced from and parallel to the table, the side dies being laterally movable toward and away from a central portion of the table; the side die moving means mounted to the table for moving each side die; a top die supported above the table by a support means, the top die assembly being movable upwardly and downwardly and aligned to contact the table at a location midway between the side dies; the top die assembly comprising an upper die plate affixed to a moving means and a lower die plate spaced down and parallel to the upper die plate, the lower die plate being under the upper die plate; and the top die moving means mounted to the support means, for moving the top die.

These and other objects and advantages will be made evident from the detailed description which follows and is to be read in conjunction with the drawings.

BRIEF DESCRIPTION OF THE DRAWINGS

FIG. 1 is an elevation view illustrating pre-cut material for pocket production.

FIG. 2 is an elevation view illustrating the pocket material of FIG. 1, in folded condition, the folds being shown in phantom.

FIG. 3 is a perspective view of the pocket creasing machine of the present invention.

DETAILED DESCRIPTION OF THE PREFERRED EMBODIMENT

Cut out pocket material is illustrated in FIG. 1 folded and ironed, ready for sewing after the creasing process described below. Creases are shown by dotted lines in FIG. 2. After creasing by the present system the pocket material is passed to a stitching operation.

Figure 7:
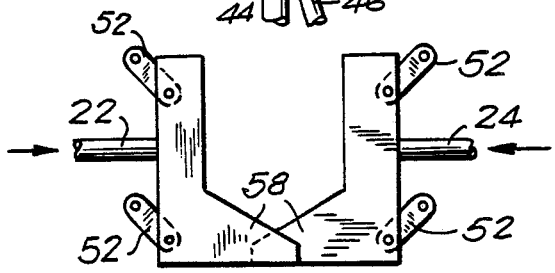
FIG. 7 is a schematic view from the top illustrating the motion of plates 18 and 20.

FIG. 3 is a perspective view of the creasing machine of the present invention. The machine comprises a frame 12 and a table 14. A heated plate 16 is supported by lower cylinder 44 which is affixed to the table. Plate 16 may be heated by any conventional means such as heating elements 48. In a preferred embodiment a steam feed line 46 is provided supply steam to facilitate the creasing operation. A stainless steel mesh screen 50 is provided on the upper surface of plate 16. Side die plates 18 and 20 are connected to operating cylinders 22 and 24 which, in turn, are mounted to table 14. As shown in FIG. 7, plates 18 and 20 are mounted mounted upon pivot arms 52 so that inward motion provided by cylinders 22 and 24 provides folding of edges 62 of material 10 about the forward edges of plate 38. Operating cylinders 22 and 24 may be of any suitable construction adapted for laterally translating plates 18 and 20. A control panel 26 is provided. Display features 28 and 30 may also be provided if desired.

A support bar 32 supports cylinder 34. Cylinder 34 may be of any suitable construction and is preferably a fluid cylinder. Piston 36 of cylinder 34 moves the die assembly of the present invention upwardly and downwardly. Pocket material 10 is placed between upper die plate 38 and lower die plate 40 shown in phantom. Die plates 40 is slightly larger than die plate 38 and preferably extends 1/16 inch beyond the periphery of die plate 38. Die plate 38 serves as a molding plate. Die plates 38 and 40 comprise top die assembly 42. Lower die 40 is wider than top die 38 to prevent double creasing of the pocket material. Upper and lower dies 38 and 40 may be connected by a connecting bar (not shown) located rearwardly of the dies. The folding process of the present invention will now be described.

Figure 4:
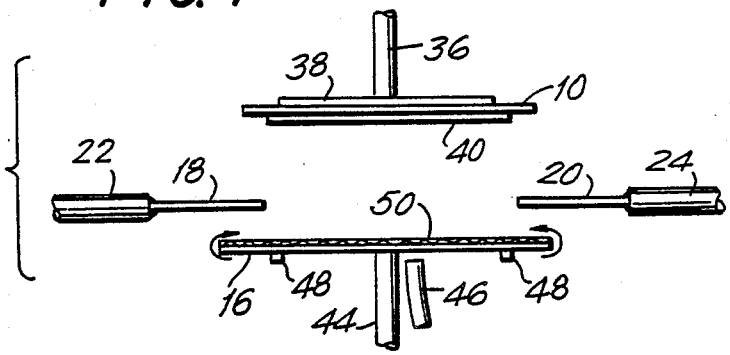
FIG. 4 is a diagrammatic view of the process of the present invention wherein the top die is in a raised position.
Figure 5:
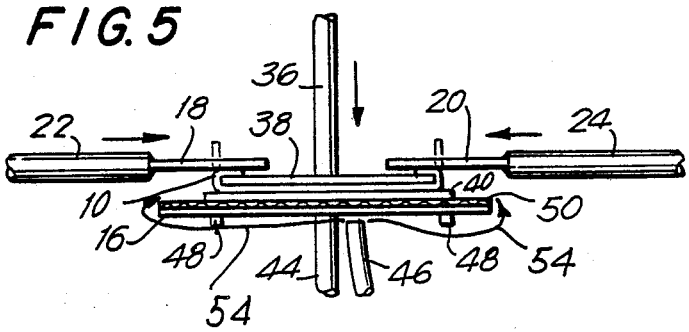
FIG. 5 is a diagrammatic view illustrating the top die in a lowered position and the side dies being translated inwardly.
Figure 6:
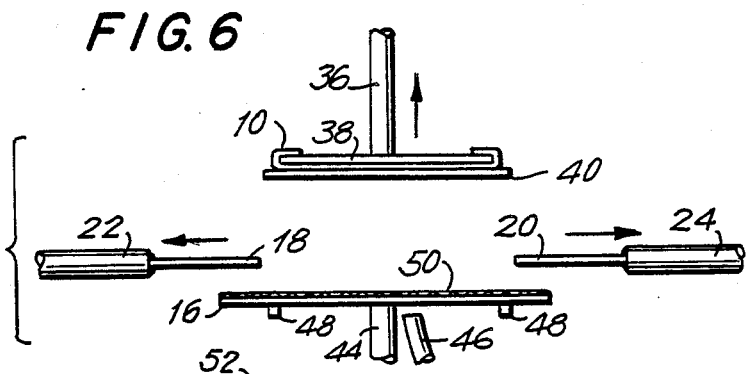
FIG. 6 is a diagrammatic view illustrating the top die moving upward and the side dies being retracted after folding.

FIGS. 4–6 illustrate the folding and creasing process of the present invention along edges 62 is shown in FIG. 7, which is to be read in conjunction with FIGS. 4–6. With specific reference to FIG. 4 pocket material 10 schematically illustrated is inserted into top die assembly 42 between lower die plate 40 and upper die plate 38, which is supported by piston 36. Loading pocket material 10 when top die assembly 42 is raised away from heated elements, facilitates precise and safe loading. Side dies 18 and 20 are aligned so that lower die plate 40 will pass therethrough when lowered, folding edges 60 of fabric 10 upwardly as shown in phantom in FIG. 5. When the top die assembly 42 is completely lowered, side dies 18 and 20 are moved inwardly by cylinders 22 and 24 respectively. At this point heat and pressure are applied to iron a crease into the folded pocket material 10. Lower cylinder 44 presses plate 16 upward at this point pressing the edges of cloth 10 against plates 18 and 20. Plate 16 is heated by heating elements 48. Steam feed line 46 feeds steam to a location below plate 16. The steam heats plate 16 and flows against the lower surface of plate 16, curling upwardly at the plate edges as illustrated by arrows 54 to permeate the cloth 10. In this manner the steam facilitates the folding process by flowing upwardly about he plate edges to facilitate the pressing of the edges of cloth 10 upwardly. Top loading enables the use of steam by removing the top die plates from the steam heated area.

In FIG. 6, the top and side dies are shown being retracted by their control cylinders and pocket cylinders and pocket material 10 is raised in a secure manner by top die assembly 42. In this manner the pocket material 10 is folded into the configuration of FIG. 2. Depending on the type of on the type of creasing desired, more than one repetition of the process of FIGS. 4–6 may be needed.

FIG. 7 is a schematic view from the top illustrating the movement of plates 18 and 20. Pistons 22 press the plates inwardly. The plates, being mounted on pivot arms 52, respond moving inwardly with flanges 58 overlapping and, due to the slanted configuration of the flanged edges of plates 18 and 20, contact the portions cloth 10 at edges 62 and fold it over plate 38. Neither pivot arms 52 nor the forward folding process which takes place at edges 62 are shown in FIGS. 4–6.

Although a detailed description of the present invention has been provided above, it is to be understood that the scope of the invention is to be defined by the claims which follow.

What is claimed is:

1. An apparatus for folding an creasing pockets comprising:

a table having a heat plate mounted thereon; first and second side die plates movably mounted upon the table and being attached to means for lateral movement; a top die assembly movable in upward and downward directions and mounted, above the table, to a support bar extending from the table, the top die assembly being raised and lowered by actuating means and comprising a lower and an upper die plate, the lower die plate being slightly wider than the upper die plate, the plates being spaced to receive material to be folded therebetween.

2. An apparatus according to claim 1 further comprising a fluid cylinder in mechanical communication with the heat plate for raising the heat plate to press material to be folded.

3. An apparatus according to claim 2 further comprising a steam fed means for feeding steam proximate to lower surface of the heat plate.

4. An apparatus according to claim 2 further comprising heating elements affixed to the heat plate.

5. An apparatus according to claim 2 wherein the actuating means of the top die assembly is a fluid cylinder.

6. An apparatus according to claim 2 wherein the side plates when moved to a first inward position form a receiving opening for the lower die plate, the receiving opening being slightly larger than the lower die plate and having substantially the same configuration as the lower die plate.

7. An apparatus according to claim 6 wherein the first and second movable side plates are mounted on pivot arms to translate the plates inwardly with respect to side edges and front edges of the material.

8. An apparatus according to claim 7 wherein the periphery of the lower die plate extends 1/16 inch wider than the upper die plate.

* * * * *